US008320786B2

(12) United States Patent
Kajiwara et al.

(10) Patent No.: US 8,320,786 B2
(45) **Date of Patent: *Nov. 27, 2012**

(54) IMAGE FORMING APPARATUS

(75) Inventors: Junichi Kajiwara, Osaka (JP); Sae Hiroki, Osaka (JP); Hiroyuki Nagao, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 402 days.

This patent is subject to a terminal disclaimer.

(21) Appl. No.: 12/686,215

(22) Filed: Jan. 12, 2010

(65) Prior Publication Data

US 2010/0183327 A1 Jul. 22, 2010

(30) Foreign Application Priority Data

Jan. 19, 2009 (JP) ..... 2009-009121

(51) Int. Cl.
*G03G 21/00* (2006.01)

(52) U.S. Cl. ..... 399/75; 399/38; 250/423 R; 361/230; 315/111.81

(58) Field of Classification Search ..... 399/38, 399/75

See application file for complete search history.

(56) References Cited

U.S. PATENT DOCUMENTS

| | | | | |
|---|---|---|---|---|
| 5,883,934 | A | 3/1999 | Umeda | |
| 6,447,731 | B1 | 9/2002 | Sun et al. | |
| 7,672,012 | B2 | 3/2010 | Silverbrook | |
| 7,854,900 | B2 | 12/2010 | Takeda et al. | |
| 8,033,515 | B2 | 10/2011 | Martin et al. | |
| 2003/0072675 | A1* | 4/2003 | Takeda et al. | 422/22 |
| 2006/0285269 | A1* | 12/2006 | Ohtsuka et al. | 361/225 |
| 2007/0167124 | A1* | 7/2007 | Gotoh et al. | 454/155 |
| 2008/0217556 | A1* | 9/2008 | Kagawa et al. | 250/423 R |
| 2010/0201775 | A1* | 8/2010 | Yoneda et al. | 347/123 |
| 2010/0201776 | A1* | 8/2010 | Tonami | 347/123 |
| 2011/0020025 | A1* | 1/2011 | Fujii et al. | 399/75 |

FOREIGN PATENT DOCUMENTS

| | | | |
|---|---|---|---|
| JP | 2002-019223 | | 1/2002 |
| JP | 2005-058731 | | 2/2002 |
| JP | 2002-226070 | | 8/2002 |
| JP | 2003-294280 | | 10/2003 |
| JP | 2004-169964 | A | 6/2004 |
| JP | 2004-233618 | | 8/2004 |
| JP | 2005-004144 | | 1/2005 |
| JP | 2006-126250 | A | 5/2006 |
| JP | 2006-343491 | A | 12/2006 |
| JP | 2008-112064 | | 5/2008 |
| JP | 2008-251514 | | 10/2008 |

OTHER PUBLICATIONS

Office Action issued in U.S. Appl. No. 12/704,919 on May 30, 2012.
Office Action issued in U.S. Appl. No. 12/702,488, dated May 7, 2012.

* cited by examiner

*Primary Examiner* — Walter L Lindsay, Jr.
*Assistant Examiner* — Benjamin Schmitt
(74) *Attorney, Agent, or Firm* — Nixon & Vanderhye P.C.

(57) ABSTRACT

An image forming apparatus according to one embodiment of the present invention is an image forming apparatus that prints an image on a recording paper, and is provided with an ion generating means that is attached at an outer side of the image forming apparatus main unit, and generates and emits ions, and an emission direction varying means that varies an emission direction of ions from the ion generating means in response to whether the image forming apparatus is operating or in standby.

18 Claims, 10 Drawing Sheets

IMAGE FORMING APPARATUS

CROSS-REFERENCE TO RELATED APPLICATION

This application claims priority on Patent Application No. 2009-009121 filed in Japan on Jan. 19, 2009, the entire contents of which are hereby incorporated by reference.

BACKGROUND OF THE INVENTION

The present invention relates to image forming apparatuses such as copiers, printers, and facsimile machines.

Electrophotographic apparatuses are an example of this type of image forming apparatus. In electrophotographic apparatuses, a toner image is formed on a surface of a photosensitive drum by forming an electrostatic latent image on the surface of the photosensitive drum, then developing the electrostatic latent images on the surface of the photosensitive drum using toner, and the toner image is fixed onto a recording paper by transferring the toner image to the recording paper from the photosensitive drum and by applying heat and pressure to the recording paper.

This type of image forming apparatus sometimes produces harmful exhaust gases during print processing of the recording paper. Main constituents of these exhaust gases include longifolene and the like, which are presumed to be emitted from the recording paper.

Image forming apparatuses are essential office automation appliances and are installed in most offices, moreover they are also becoming widespread in homes and hospitals. Thus, harmful exhaust gases from image forming apparatuses cause discomfit to many users.

For example, in JP 2005-4144A (hereinafter referred to as patent document 1), components such as a ventilation fan, a negative ion generating portion, and a positively charged filter are installed inside the image forming apparatus, and toner powder and dust produced inside the apparatus are negatively charged, then the negatively charged toner powder and dust are adsorbed in the positively charged filter such that there is a reduction in harmful substances that are discharged outside the apparatus. Simultaneously, substances such as dust and mold attempting to enter the image forming apparatus from outside are negatively charged, then these are also adsorbed in the positively charged filter, thereby suppressing the entrance of harmful substances from outside the apparatus.

On the other hand, air purifying devices that purify the air in a room are becoming widespread in offices, homes, and hospitals and the like.

For example, in JP 2002-58731A (hereinafter referred to as patent document 2), positive ions and negative ions are produced simultaneously, and airborne microbes in the air are effectively eliminated by the positive ions and negative ions.

However, in patent document 1, it is necessary to provide a negative ion generating portion and a positively charged filter and the like that are not directly related to the copying of the image forming apparatus, and these cause the apparatus to be larger and increase costs.

Furthermore, although the air in a room can be purified according to patent document 2, this does not purify the exhaust gases of an image forming apparatus.

Further still, it is extremely uneconomical to provide both a high cost image forming apparatus as in patent document 1 as well as an air purifying device as in patent document 2.

SUMMARY OF THE INVENTION

However, the inventors of the present invention discovered that the influence of exhaust gases can be suppressed depending on an ion emission method by generating and emitting ions outside the image forming apparatus without providing a negative ion generating portion and a filter and the like inside the image forming apparatus as in patent document 1. And switching ideas as described above led to devising an image forming apparatus of the present invention, which is capable of suppressing the influence of exhaust gases of the image forming apparatus and purifying the air in a room.

In this manner, the present invention was devised to address the above-described issues, and it is an object thereof to provide an image forming apparatus that is capable of suppressing the influence of exhaust gases of an image forming apparatus and purifying the air in a room.

In order to address the above-described issues, an image forming apparatus according to the present invention that prints an image on a recording paper, is provided with: an ion generating means that is attached at an outer side of the image forming apparatus main unit, and generates and emits ions, and an emission direction varying means that varies an emission direction of ions from the ion generating means in response to whether the image forming apparatus is operating or in standby.

In the foregoing configuration, the ion generating means may be configured to simultaneously generate and emit positive ions and negative ions.

Furthermore, the emission direction varying means may set an emission direction of ions from the ion generating means in a direction toward the image forming apparatus side during operation of the image forming apparatus and set an emission direction of ions from the ion generating means in a direction toward an opposite side from the image forming apparatus during standby of the image forming apparatus.

Further still, the ion generating means may be arranged above the image forming apparatus, and the emission direction varying means may set an emission direction of ions from the ion generating means in a direction toward the image forming apparatus side during operation of the image forming apparatus and set an emission direction of ions from the ion generating means in a direction toward an upper side during standby of the image forming apparatus.

Furthermore, the emission direction varying means may vary an emission direction of ions from the ion generating means by varying an orientation of the ion generating means.

Further still, the ion generating means may be provided with an ion emission duct surrounded by a duct wall, and the duct wall may be movable, and the emission direction varying means may vary an emission direction of ions by causing the duct wall of the emission duct to move.

Furthermore, the emission direction varying means may carry out a swinging operation of repetitively causing the emission direction of ions from the ion generating means to move in a reciprocating manner.

Further still, the emission direction varying means may vary an emission direction of ions from the ion generating means in response to a signal indicating commencement of operation of the image forming apparatus during standby of the image forming apparatus.

The image forming apparatus may be provided with an operation means and an interface connected to an external terminal device, and the signal that indicates commencement of operation of the image forming apparatus may be any of a print instruction signal generated in response to an input operation of the operation means and a print instruction signal received and inputted from the external terminal device to the interface.

Furthermore, the ion generating means may be supported by a support member that is provided protruding upward from the image forming apparatus. For example, the support member may be provided protruding upward from a corner of a rear surface side of the image forming apparatus, and support an end portion of the ion generating means. Alternatively, the support member may be provided protruding upward from a center of a rear surface side of the image forming apparatus, and support a center of the ion generating means.

Further still, the ion generating means may be provided with an ion generating element that generates ions, and a ventilation fan that generates a flow of air passing near the ion generating element so as to emit the ions along with the air.

In the present invention, an emission direction varying means varies an emission direction of ions from the ion generating means in response to whether the image forming apparatus is operating or in standby. Since exhaust gases are produced when the image forming apparatus is operating, it is preferable that the emission direction of ions is set so that reductions in odors of exhaust gases are effectively carried out, but since exhaust gases are not produced when the image forming apparatus is in standby, it is preferable that the emission direction of ions is set so that the elimination of airborne microbes in the air is carried out effectively. That is, the influence of exhaust gases of the image forming apparatus is suppressed and the air in a room is purified, thereby fulfilling two roles with a single apparatus.

Furthermore, since the ion generating means is attached outside the image forming apparatus, the main unit does not become larger, and the space in a room can be used effectively without it being necessary to provide a separate air purifying device.

For example, positive ions and negative ions are simultaneously generated and emitted from the ion generating means. Positive ions and negative ions can effectively eliminate airborne microbes in the air and can effectively reduce the odor of exhaust gases of the image forming apparatus, and are therefore preferable in the present invention.

Furthermore, the emission direction varying means sets the emission direction of ions towards the image forming apparatus during operation of the image forming apparatus. In this way, ions cover the image forming apparatus in the manner of an air curtain and the odors of exhaust gases of the image forming apparatus are effectively suppressed. Furthermore, the emission direction varying means sets the emission direction of ions in a direction toward an opposite side from the image forming apparatus during standby of the image forming apparatus. In this way, ions are dispersed widely in the room and air in the room is effectively purified.

Alternatively, the ion generating means is arranged above the image forming apparatus and the emission direction of ions is set in a direction toward the image forming apparatus side during operation of the image forming apparatus, and the emission direction of ions faces upward during standby of the image forming apparatus. When ions are emitted downward to the image forming apparatus side, the image forming apparatus can be easily covered by ions, thereby ensuring reliable suppression of exhaust gases by ions. Furthermore, when ions are emitted to an upper side, ions are dispersed among the entire room and air purification is carried out over a wide area.

Furthermore, the emission direction varying means varies the emission direction of ions by varying an orientation of the ion generating means. In this case, the structure of the emission direction varying means can be simplified.

Alternatively, the emission direction varying means varies the emission direction of ions by causing the duct wall of the emission duct of ions in the ion generating means to move. In this case, there is no need to ensure space for the varying the orientation of the ion generating means and installation space can be conserved.

Further still, the emission direction varying means carries out a swinging operation of repetitively causing the emission direction of ions to move in a reciprocating manner. In this way, the emission range of ions is widened to cover the entire image forming apparatus with ions, and ions can be dispersed more widely in the room.

Furthermore, the emission direction varying means varies the emission direction of ions from the ion generating means in response to a signal indicating commencement of operation of the image forming apparatus during standby of the image forming apparatus. For example, a signal that indicates commencement of operation of the image forming apparatus may be any of a print instruction signal generated in response to an input operation of the operation means and a print instruction signal received and inputted from the external terminal device. In this way, the emission direction of ions can be switched with appropriate timings and the odors of exhaust gases of the image forming apparatus can be reliably suppressed.

Furthermore, the ion generating means is supported by a support member that is provided protruding upward from the image forming apparatus, and therefore the ion generating means overlaps above the image forming apparatus and the footprint of the apparatus is not increased. For example, the support member is provided protruding upward from a corner of a rear surface side of the image forming apparatus, and supports an end portion of the ion generating means. In this way, the space above the image forming apparatus is opened and the ease of use of the apparatus is unaffected. Alternatively, the support member is provided protruding upward from a center at one side of a rear surface side of the image forming apparatus, and supports the center of the ion generating means. In this way, the ion generating means is stably supported.

DESCRIPTION OF PREFERRED EMBODIMENTS

Hereinafter, embodiments of the present invention are described in detail with reference to the accompanying drawings.

Figure 1:
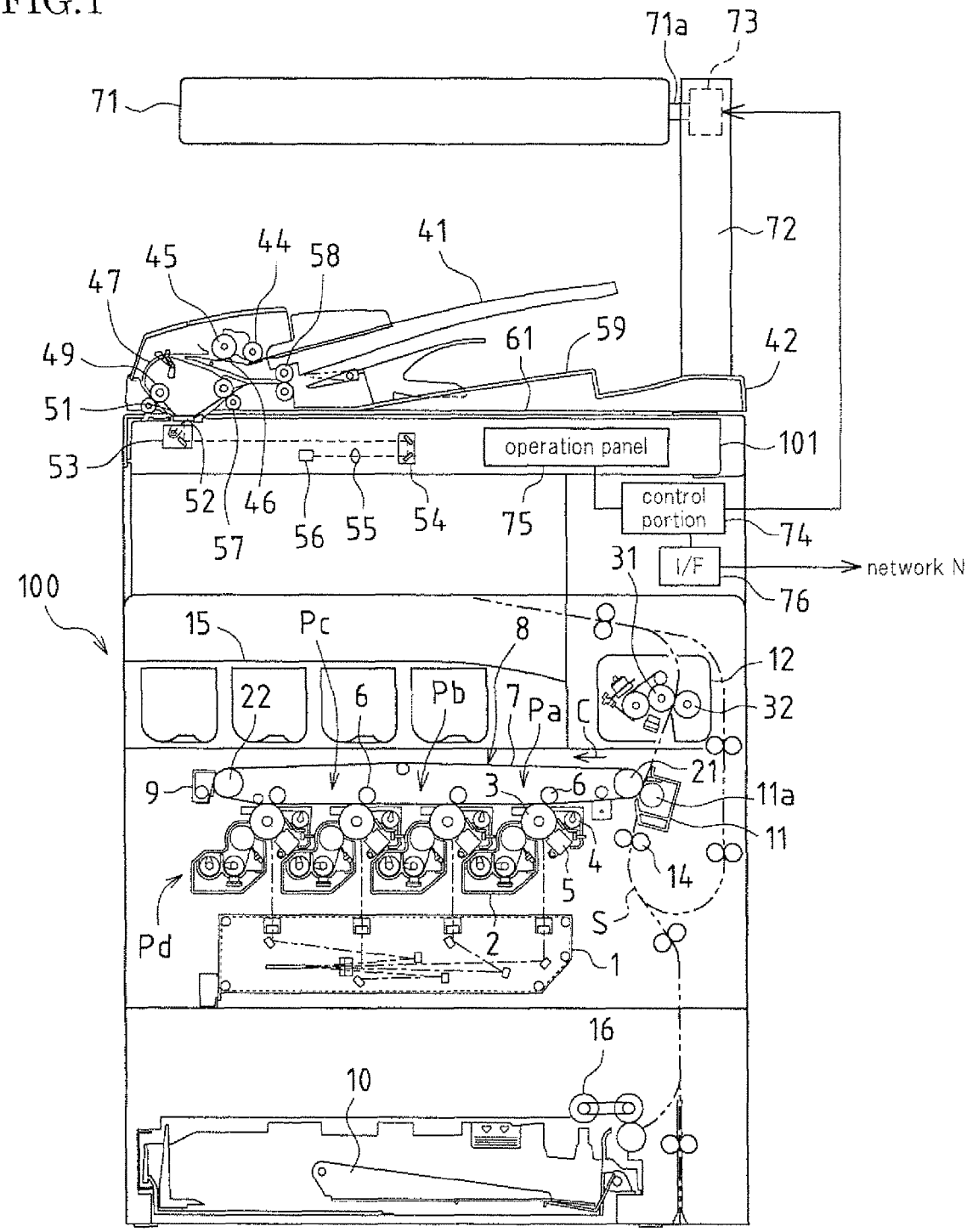
FIG. 1 is a cross-sectional view showing one embodiment of an image forming apparatus according to the present invention.

FIG. 1 is a cross-sectional view showing one embodiment of an image forming apparatus according to the present invention. An image forming apparatus 100 records and forms on a recording paper a color or monochrome image of an original that has been read by an original reading device 101 or an image received externally.

The original reading device 101 reads an image of an original that is being transported by an original transport portion 42. In the original transport portion 42, when originals are set in an original setting tray 41, an original pickup roller 44 presses against an upper surface of the originals and rotates such that originals are drawn out from the original setting tray 41 and the originals are transported to a transport path 47 after being separated sheet by sheet by passing between a separator roller 45 and a separation pad 46.

On the transport path 47, a leading edge of the original makes contact against original registration rollers 49 and the leading edge of the original becomes aligned parallel to the original registration rollers 49, after which the original is transported by the original registration rollers 49 and passes between a reading guide 51 and a reading glass 52. Further still, the original is transported by transport rollers 57 and discharged to a discharge tray 59 by way of discharge rollers 58.

In the original reading device 101, when the original passes between the reading guide 51 and the reading glass 52, light from a light source of a first scanning portion 53 irradiates a front surface of the original through the reading glass 52, and reflected light thereof is incident on the first scanning portion 53 through the reading glass 52, and this reflected light is reflected by mirrors of the first scanning portion 53 and a second scanning portion 54 to be guided to an image forming lens 55, then an image of the original undergoes image formation on a CCD (charge coupled device) 56 by the image forming lens 55. The CCD 56 reads an image of the original and outputs image data that indicates an image of the original.

Furthermore, it is possible to read an original that has been placed on a platen glass 61. The original transport portion 42 is pivotably supported to be openable and closable at a rear surface side of the original reading device 101, and when the original transport portion 42 is opened, the platen glass 61 is uncovered such that it is possible to place an original on the platen glass 61. When an original is placed and the original transport portion 42 closes, the first and second scanning portions 53 and 54 move in a sub-scanning direction while the surface of the original on the platen glass 61 is exposed by the first scanning portion 53, then the reflected light from the surface of the original is guided to the image forming lens 55 by the first and second scanning portions 53 and 54, and an image of the original undergoes image formation on the CCD 56 by the image forming lens 55. At this time, the first and second scanning portions 53 and 54 move while maintaining a predetermined velocity relationship with each other, and a positional relationship of the first and second scanning portions 53 and 54 is constantly maintained such that an optical path length of the light reflected in order thereafter from the surface of the original, the first scanning portion 53, the second scanning portion 54, the image forming lens 55, and the CCD 56 does not vary, and in this way a focus of the image of the original on the CCD 56 is always maintained accurately.

An entire image of the original that is read in this manner undergoes transmission as image data to a laser exposure device 1 of the image forming apparatus 100, and the image is recorded onto a recording paper in the image forming apparatus 100.

On the other hand, the image forming apparatus 100 is constituted by components such as the laser exposure device 1, a development device 2, a photosensitive drum 3, a charging unit 5, a cleaner device 4, an intermediate transfer belt device 8, a fixing device 12, a paper transport path S, a paper feeding tray 10, and a paper discharge tray 15.

The image data handled in the image forming apparatus 100 corresponds to color images using each of the colors black (K), cyan (C), magenta (M), and yellow (Y), or corresponds to a monochrome image using a single color (for example, black). Accordingly, four sets each of the development device 2, the photosensitive drum 3, the charging unit 5, and the cleaner device 4 are provided to form four latent images corresponding to the four colors, with these being associated with black, cyan, magenta, and yellow respectively, thereby constituting four image stations Pa, Pb, Pc, and Pd.

The photosensitive drums 3 are arranged substantially at a center of the image forming apparatus 100.

The charging units 5 are charging means for uniformly charging the surface of the photosensitive drums 3 to a predetermined electric potential and in addition to contact types such as roller and brush charging units, charger-type charging units are also used.

The laser exposure device 1 is a laser scanning unit (LSU) provided with a laser diode and reflector mirrors, and this exposes the surfaces of the charged photosensitive drums 3 in response to image data such that electrostatic latent images are formed on the surfaces corresponding to the image data.

The development apparatuses 2 use (K, C, M, and Y) toner to develop the electrostatic latent images formed on the photosensitive drums 3. The cleaner devices 4 remove and collect toner that is residual on the surfaces of the photosensitive drums 3 after development and image transfer.

The intermediate transfer belt device 8 positioned above the photosensitive drums 3 is provided with an intermediate transfer belt 7, an intermediate transfer belt drive roller 21, an idler roller 22, intermediate transfer rollers 6, and an intermediate transfer belt cleaning device 9.

The intermediate transfer belt 7 spans in a tensioned state and is supported by the intermediate transfer belt drive roller 21, the intermediate transfer rollers 6, and the idler roller 22 and the like. The intermediate transfer belt 7 is caused to move there-around in a direction of arrow C.

The intermediate transfer rollers 6 are rotatably supported near the intermediate transfer belt 7, and press against the photosensitive drums 3 through the intermediate transfer belt 7, with a transfer bias being applied thereto for transferring the toner images on the photosensitive drums 3 to the intermediate transfer belt 7.

The intermediate transfer belt 7 is arranged so as to contact each of the photosensitive drums 3 and forms a color toner image (toner images of each color) by successively superimposing and transferring the toner image on the surface of each of the photosensitive drums 3 onto the intermediate transfer belt 7. The transfer belt is formed as an endless belt using a film of a thickness in a range of 100 μm to 150 μm.

Transfer of the toner images from the photosensitive drums 3 to the intermediate transfer belt 7 is carried out by the intermediate transfer rollers 6 that press against the rear surface of the intermediate transfer belt 7. A high voltage transfer bias (a high voltage (+) that has opposite polarity to the charge polarity (−) of the toner) is applied to the intermediate transfer rollers 6 to achieve transfer of the toner images. The intermediate transfer rollers 6 are based on metal (for example stainless steel) axles with a diameter of 8 to 10 mm and the surfaces thereof are covered by a conductive elastic material (for example, EPDM and urethane foam or the like). With this conductive elastic material, it is possible to uniformly apply a high voltage to a recording paper.

As described above, the toner image on the surface of each of the photosensitive drums 3 is layered onto the intermediate transfer belt 7 to become a color toner image indicated by image data. The layered toner images of each color are transported with the intermediate transfer belt 7 then transferred onto a recording paper by a transfer roller 11*a* of a secondary transfer device 11 that is in contact with the intermediate transfer belt 7.

The intermediate transfer belt 7 and the transfer roller 11*a* of the secondary transfer device 11 are pressed to each other so as to form a nip region. Furthermore, a voltage (a (+) high voltage that has opposite polarity to the (−) charge polarity of the toner) is applied to the transfer roller 11*a* of the secondary transfer device 11 in order for the toner images of each color on the intermediate transfer belt 7 to be transferred to the recording paper. Further still, in order to steadily obtain the nip region thereof, either the transfer roller 11*a* of the secondary transfer device 11 or the intermediate transfer belt drive roller 21 is provided as a hard material (a metal or the like) and the other of these is provided as a soft material such as an elastic roller (elastic rubber roller or foam resin roller or the like).

Furthermore, sometimes the toner images on the intermediate transfer belt 7 are not completely transferred onto the recording paper by the secondary transfer device 11 and there is residual toner on the intermediate transfer belt 7, and this residual toner is a cause of mixed toner colors occurring at subsequent steps. For this reason, residual toner is removed and collected by the intermediate transfer belt cleaning device 9. In the intermediate transfer belt cleaning device 9, a cleaning blade is provided for example as a cleaning member that contacts the intermediate transfer belt 7 and removes residual toner, and the rear side of the intermediate transfer belt 7 is supported by the idler roller 22 at a position where the cleaning blade contacts the intermediate transfer belt.

The paper feeding tray 10 is a tray for storing recording paper and is provided below an image forming portion of the image forming apparatus 100 to supply the recording paper inside the tray.

An S-shaped sheet transport path S is provided in the image forming apparatus 100 for sending the recording paper supplied from the paper feeding tray 10 to the paper discharge tray 15 via the secondary transfer device 11 and the fixing device 12. Arranged along the sheet transport path S are components such as a paper pickup roller 16, paper registration rollers 14, the fixing device 12, and transport rollers that transport the recording papers.

The paper pickup roller 16 is provided at an end portion of the paper feeding tray 10 and is a draw-in roller that supplies recording papers sheet by sheet from the paper feeding tray 10 to the paper transport path S. The transport rollers are small-size rollers for facilitating and assisting the transport of the recording papers and a plurality of these are provided.

The paper registration rollers 14 temporarily stop the recording paper that has been transported in and align the leading edge of the recording paper, then transport the recording paper in a timing that matches the rotation of the photosensitive drums 3 and the intermediate transfer belt 7 so that the color toner image on the intermediate transfer belt 7 is transferred to the recording paper at the nip region between the intermediate transfer belt 7 and the transfer roller 11*a* of the secondary transfer device 11.

For example, the paper registration rollers 14 transport the recording papers based on detection output of a pre-registration detection switch (unshown) so that the leading edge of the color toner image on the intermediate transfer belt 7 matches the leading edge of the image formation region of the recording paper at the nip region between the intermediate transfer belt 7 and the transfer roller 11*a* of the secondary transfer device 11.

The fixing device 12 is provided with components such as a hot roller 31 and a pressure roller 32. The hot roller 31 and the pressure roller 32 sandwich and transport the recording paper that has passed through the nip region between the intermediate transfer belt 7 and the transfer roller 11*a* of the secondary transfer device 11.

The hot roller 31 is controlled based on detection output from an unshown temperature detector so as to reach a predetermined fixing temperature, and has a function of melting, mixing, and pressing the toner image that has been transferred onto the recording paper to thermally fix it to the recording paper by applying thermocompression to the recording paper along with the pressure roller 32.

After the toner images of each color have been fixed, the recording paper is discharged face down on the paper discharge tray 15 by the transport rollers.

When printing of a recording paper is carried out in the image forming apparatus 100 using an electrophotographic method as described above, there are times when harmful exhaust gases are produced. Main constituents of these exhaust gases include longifolene and the like, which are presumed to be emitted from the recording paper.

Not taking any action against these harmful exhaust gases causes discomfit to users of the image forming apparatus 100 and is not preferable.

Figure 2B:
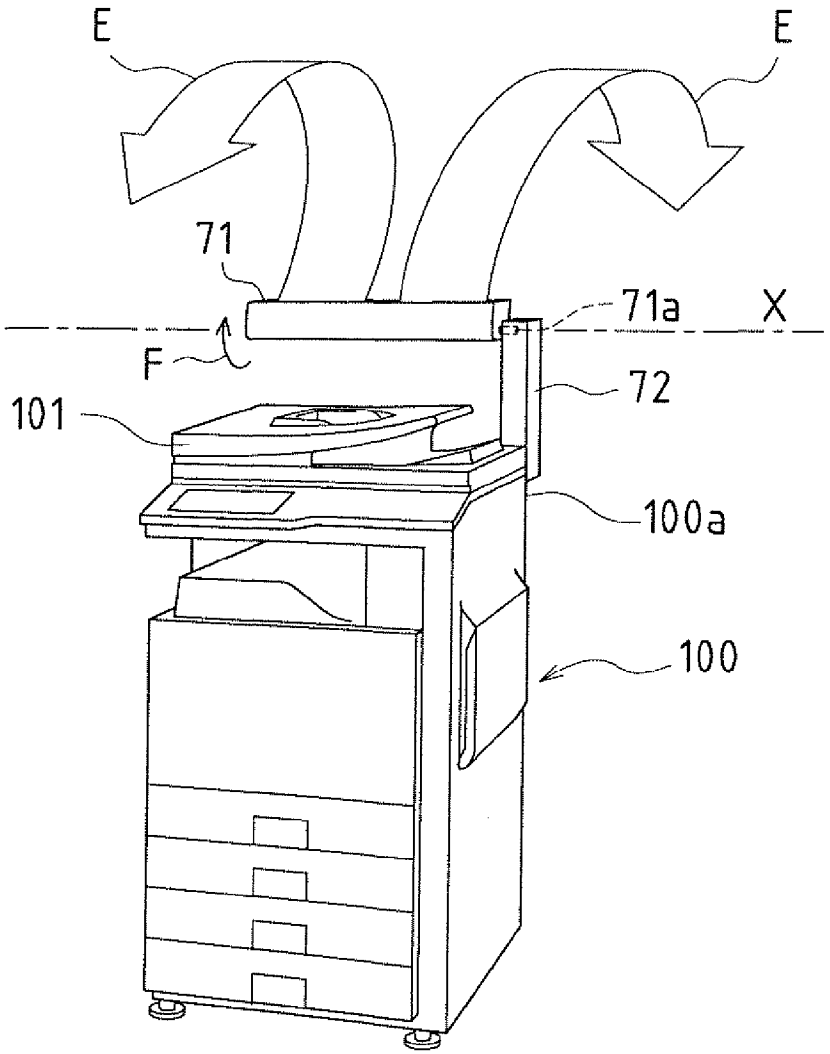
FIG. 2A and FIG. 2B are perspective views showing emission directions of positive ions and negative ions from the ion generating device of the image forming apparatus of FIG. 1.
Figure 2A:
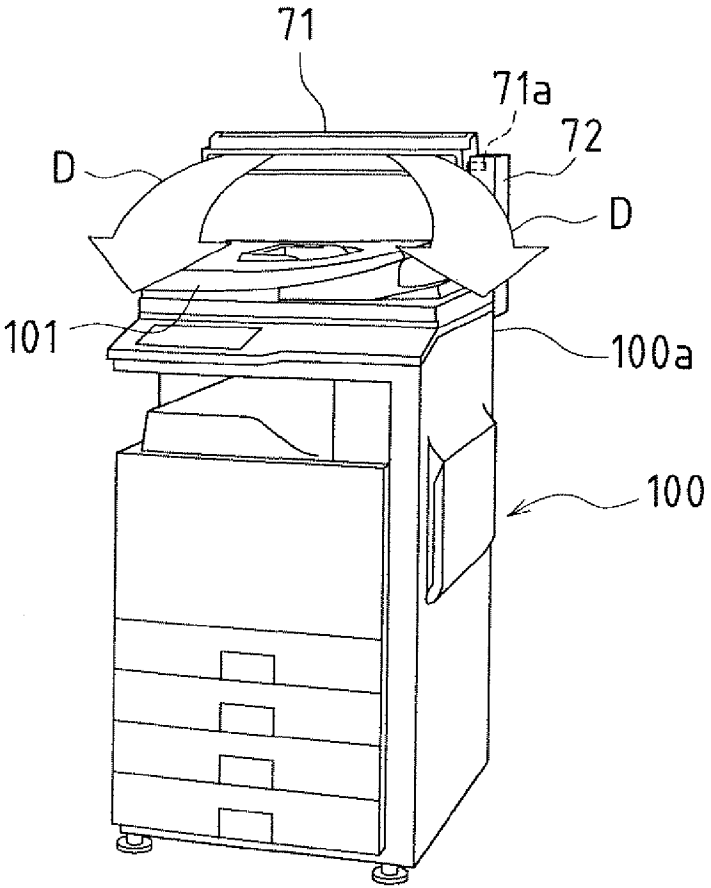

Accordingly, in the image forming apparatus 100 according to the present embodiment, an ion generating device 71 is provided above the main unit of the image forming apparatus 100 as shown in FIG. 1 and FIG. 2A, and positive ions and negative ions are generated by the ion generating device 71, then the positive ions and negative ions are emitted diagonally downward from the ion generating device 71 as shown by the arrows D. Due to this, positive ions and negative ions mainly cover the front side of the main unit of the image forming apparatus 100 in a manner of an air curtain, thereby eliminating the odor of the exhaust gases. It has been confirmed in testing that the influence of exhaust gases is effectively suppressed from outside the image forming apparatus 100 also due to these positive ions and negative ions.

Furthermore, since exhaust gases are not produced in a standby state of the image forming apparatus 100, the emission directions of positive ions and negative ions from the ion generating device 71 may be changed to upward directions as shown by the arrows E in FIG. 2B such that positive ions and negative ions are dispersed among the entire room, and airborne microbes in the air are eliminated by the positive ions and negative ions such that air purification is carried out for a wide area.

Here, the emission directions of the positive ions and negative ions are set diagonally downward as shown by the arrows D, but there is no limitation to the direction of the arrows D, and the emission directions of positive ions and negative ions may be changed so long as the ions are emitted in a direction toward the side of the image forming apparatus 100 such that positive ions and negative ions cover the image forming apparatus 100. Furthermore, the emission directions of the positive ions and negative ions are set upward as shown by the arrows E, but there is no limitation to the direction of the arrows E, and the emission directions of positive ions and negative ions may be changed so long as the positive ions and negative ions are emitted to an area X of an upward orientation shown by the dashed-dotted line in FIG. 2B. Further still, there is no limitation to the area X of an upward orientation, and the emission directions of the positive ions and negative ions may be changed to orientations of an opposite side to the image forming apparatus 100 that performs dispersion to an entire room.

As is evident from FIG. 1 and FIGS. 2A and 2B, a support prop 72 is arranged protruding from a corner 100*a* of a rear surface side of the main unit of the image forming apparatus 100, and a shaft 71*a* of one end side of the ion generating device 71 is supported so as to be rotatable in an F arrow direction at an upper end of the support prop 72, and the shaft 71*a* of the ion generating device 71 is connected to an output shaft of a motor drive unit 73. The shaft 71*a* of the ion generating device 71 is rotationally driven in a reciprocating manner by the motor drive unit 73 such that the ion generating device 71 is rotated in a reciprocating manner in the direction shown by the arrow F, and the emission direction of positive ions and negative ions from the ion generating device 71 is changed to any of the orientations of the arrows D and arrows E.

As shown in FIG. 1, the motor drive unit 73 is connected to a control portion 74 that is inside the image forming apparatus 100, and is driven and controlled by the control portion 74. The control portion 74 administers not only the control of the motor drive unit 73, but also the control of the entire image forming apparatus 100, and controls the rotational position of the ion generating device 71 by driving and controlling the motor drive unit 73 in response to operational conditions of the image forming apparatus 100 such that the emission direction of ions from the ion generating device 71 is set to any of the orientations of the arrows D and arrows E.

As shown in FIG. 1 and FIGS. 2A and 2B, the support prop 72 is arranged at the corner 100*a* of the rear surface side of the main unit, and the ion generating device 71 is held horizontally in a cantilever manner by the support prop 72, and therefore the space above the image forming apparatus 100 is open and the ease of use of the image forming apparatus 100 is unaffected. Furthermore, the image forming apparatus 100 is configured such that its rear surface side is arranged facing a wall or the like. For this reason, the ion generating device 71 is provided at the rear surface side of the image forming apparatus 100 and the ion generating device 71 is arranged at a wall so as to be unobtrusive.

Figure 3:
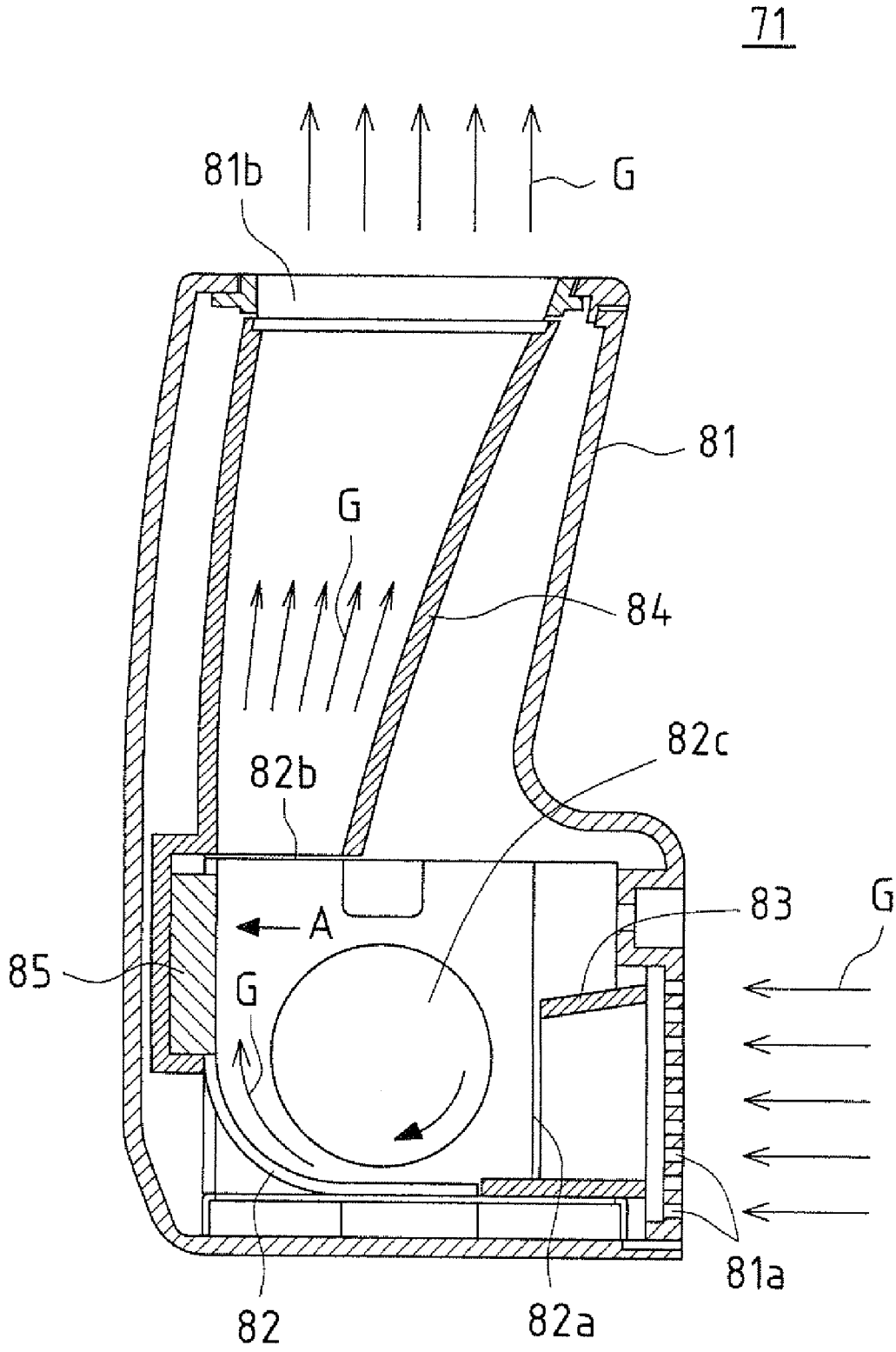
FIG. 3 is a cross-sectional view showing the ion generating device of the image forming apparatus of FIG. 1.

FIG. 3 is a cross-sectional view showing the ion generating device 71. The ion generating device 71 is provided with a main casing 81, a fan unit 82 arranged at a lower portion of the main casing 81, an intake duct 83 arranged between a plurality of intake holes 81*a* formed at a lower side wall of the main casing 81 and an intake aperture 82*a* of the fan unit 82, an emission duct 84 arranged between an upper portion blow aperture 81*b*, which is formed at an upper portion of the main casing 81, and a blow aperture 82*b* of the fan unit 82, and a plurality of ion generating elements 85 arranged around the fan unit 82.

As shown in FIG. 1 and FIGS. 2A and 2B, the length of the ion generating device 71 runs along the width direction of the image forming apparatus 100, and therefore the lengths of the main casing 81, the fan unit 82, the intake holes 81*a*, the intake duct 83, the blow aperture 82*b*, and the emission duct 84 also run along the width direction of the image forming apparatus 100, and the plurality of ion generating elements 85 are arranged along the width direction of the image forming apparatus 100.

When a fan 82*c* of the fan unit 82 is rotationally driven by a motor (not shown in drawings), airflow is generated as shown by the arrows G, and air is drawn into the fan unit 82 from the intake holes 81*a* via the intake duct 83, then after the air has passed near the ion generating elements 85, the air is emitted from the upper portion blow aperture 81*b* via the emission duct 84.

In a same manner as the motor drive unit 73, the motor (not shown in drawings) of the fan 82*c* is connected to the control portion 74 that is inside the image forming apparatus 100, and is driven and controlled by the control portion 74.

Figure 4:
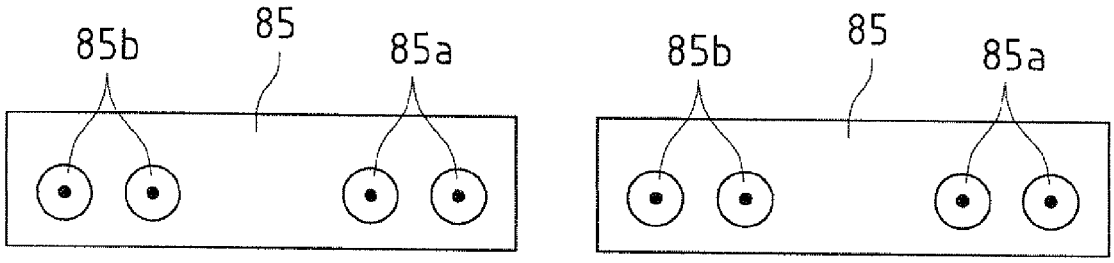
FIG. 4 is a top view illustrating Plasmacluster ion generating elements of the ion generating device of FIG. 3.

The ion generating elements 85 are Plasmacluster ion (registered trademark) generating elements (PCI). When the ion generating elements 85 are viewed from the arrow A direction in FIG. 3, two sets of ion generating elements 85 are arrayed in the width direction of the image forming apparatus 100 as shown in FIG. 4, and for each of the ion generating elements 85 there is arrayed a pair of positive ion generating portions 85*a* that generate positive ions and a pair of negative ion generating portions 85*b* that generate negative ions. This type of ion generating elements 85 is disclosed in detail in patent document 2.

The positive ions and negative ions generated by the ion generating elements 85 are emitted from the upper portion blow aperture 81*b* via the emission duct 84 along with the airflow generated by the fan 82*c* of the fan unit 82.

In this configuration, the control portion 74 shown in FIG. 1 administers the control of the entire image forming apparatus 100 as stated earlier, and when the power switch is turned on, the control portion 74 drives and controls each portion of the image forming apparatus 100 according to a preset procedure to set the image forming apparatus 100 to a standby state.

In this standby state, copying of an original image can be instructed by an input operation of an operation panel 75. Upon input of a print instruction signal that instructs copying based on an input operation of the operation panel 75, the control portion 74 commences operation of the image forming apparatus 100 in accordance with the print instruction signal to set an operating state of the image forming apparatus 100, then reads an original image and copies to recording paper the original image that has been read. In this case, the image forming apparatus 100 functions as a copier.

Furthermore, the image forming apparatus 100 is provided with an interface 76 connected to a network, and external terminal devices (not shown in drawings) such as personal computers are connected via a network N such that image and print instruction signals from the external terminal devices are received at the interface 76. The control portion 74 inputs the received image and print instruction signals and commences operation of the image forming apparatus 100 in accordance with the print instruction signals to set an operating state of the image forming apparatus 100, then prints the image onto recording paper. In this case, the image forming apparatus 100 functions as a printer.

Further still, after print processing is completed, the image forming apparatus 100 again goes into a standby state when a specified time has elapsed without print processing being executed, then waits for input of next print instruction signals.

It should be noted that standby state refers to a state in which print processing is not being executed, but a state in which a transition to execution of print processing can be made promptly.

Figure 5:
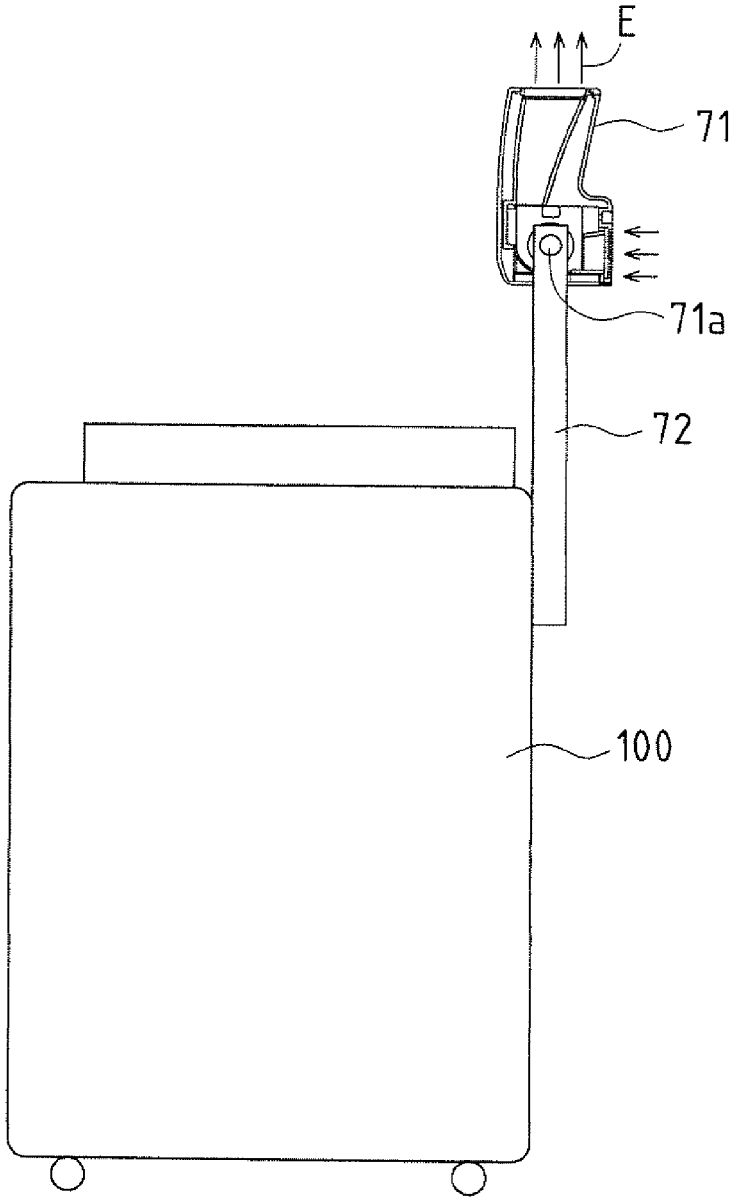
FIG. 5 is a lateral view showing a state in which the emission direction of ions from the ion generating device of FIG. 3 in the image forming apparatus of FIG. 1 is set upward.

Here, when the image forming apparatus 100 is set to the standby state, the control portion 74 drives and controls the motor drive unit 73 to control the rotational position of the ion generating device 71 such that the emission direction of ions from the ion generating device 71 is set to an upward direction as shown by the arrows E in FIG. 2B and FIG. 5. In this way, positive ions and negative ions are dispersed among the entire room and airborne microbes in the air are eliminated by the positive ions and negative ions such that air purification is carried out in a wide area. Generally, the setting time of a standby state of the image forming apparatus 100 is longer than the setting time of its operating state, and therefore if positive ions and negative ions are dispersed among an entire room when the image forming apparatus 100 is in a standby state, air purification is performed effectively.

At this time the control portion 74 may cause the ion generating device 71 to rotate in a reciprocating manner around the shaft 71*a* within a prescribed angle range using drive control of the motor drive unit 73. That is, the ion generating device 71 is operated in a swinging manner. In this way, the emission range of positive ions and negative ions can be widened.

Alternatively, the control portion 74 may increase the rotational speed of the fan 82*c* using drive control of the motor of the fan 82*c* of the fan unit 82. In this way, the emission speed and emission quantity of air from the ion generating device 71 is increased and the emission range of positive ions and negative ions is further widened.

Figure 6:
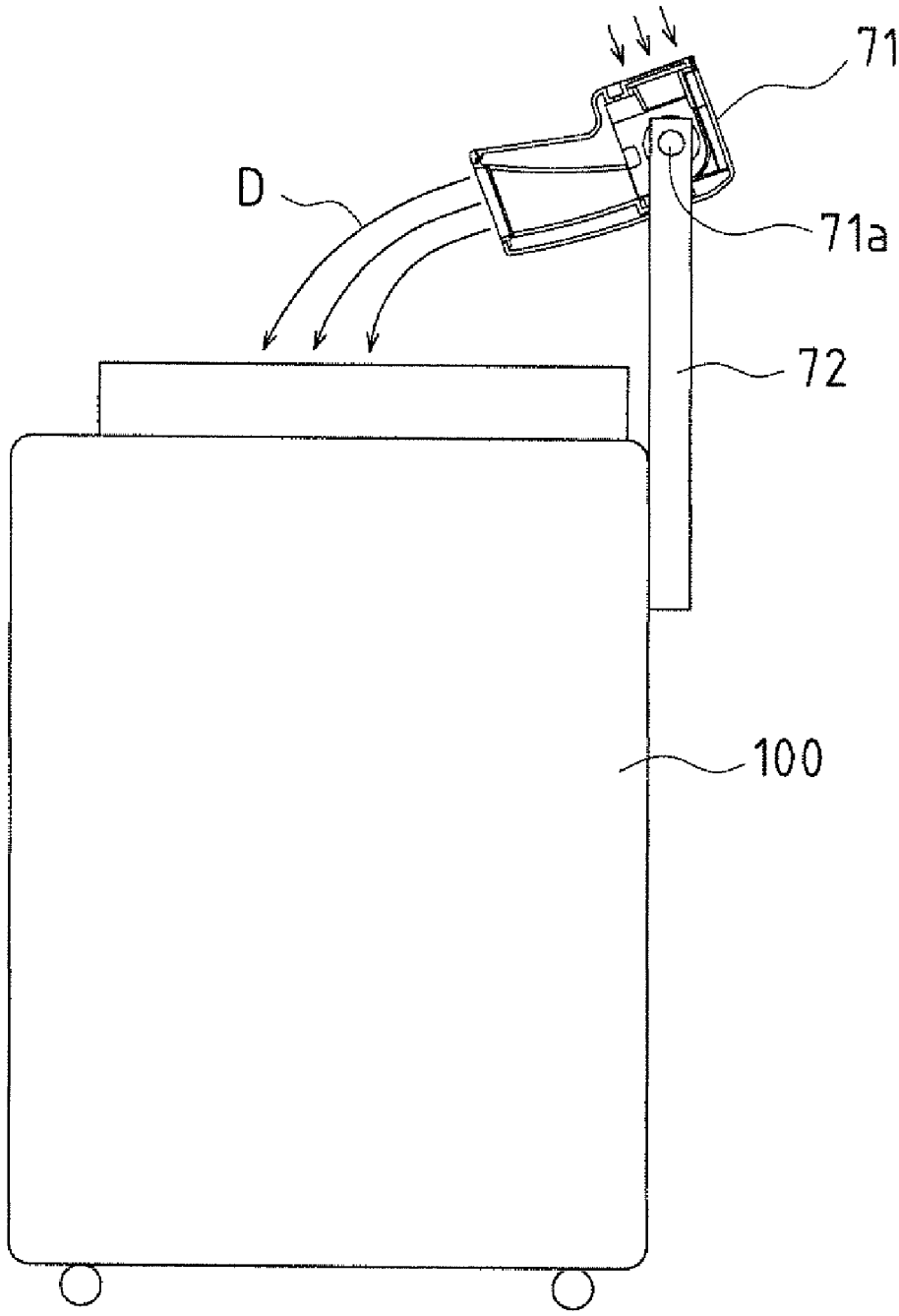
FIG. 6 is a lateral view showing a state in which the emission direction of ions from the ion generating device of FIG. 3 in the image forming apparatus of FIG. 1 is set diagonally downward.

Here, when the image forming apparatus 100 is set to the operating state, the control portion 74 drives and controls the motor drive unit 73 to control the rotational position of the ion generating device 71 such that the emission direction of ions from the ion generating device 71 is set to a diagonally downward direction as shown by the arrows D in FIG. 2A and FIG. 6. Due to this, the front side of the main unit of the image forming apparatus 100 is mainly covered by positive ions and negative ions, thereby eliminating the odor of exhaust gases. Ordinarily, the user stands in front of the main unit of the image forming apparatus 100, and therefore if positive ions and negative ions are emitted in the direction of the arrows D and positive ions and negative ions mainly cover the front side of the main unit of the image forming apparatus 100, then it is possible to effectively eliminate the odor of exhaust gases near the user.

At this time, the control portion 74 may cause the ion generating device 71 to rotate in a reciprocating manner around the shaft 71*a* within a prescribed angle range using drive control of the motor drive unit 73, thereby causing a swinging operation of the ion generating device 71.

Alternatively, the control portion 74 may decrease the rotational speed of the fan 82*c* using drive control of the motor of the fan 82*c* of the fan unit 82. In this way, air from the ion generating device 71 is emitted moderately and the flow of air describes gradually downward turning curves as shown by the arrows D such that positive ions and negative ions are dispersed moderately without air being strongly blown onto the user standing in front of the main unit of the image forming apparatus 100, and thereby making it possible to reliably cover the front side of the main unit of the image forming apparatus 100 with positive ions and negative ions.

In this way, with the present embodiment, the orientation of the ion generating device 71 is controlled in response to the standby state and operating state of the image forming apparatus 100 to vary the emission direction of positive ions and negative ions from the ion generating device 71, and therefore air purification can be carried out during the standby state and the odors of exhaust gases can be eliminated during the operating state such that a single ion generating device 71 can be used for two roles.

Furthermore, it has been confirmed in testing that the influence of exhaust gases of the image forming apparatus 100 is effectively suppressed if ions cover the image forming apparatus 100 in the manner of an air curtain. For this reason, the ion generating device 71 can be arranged on an outer side of the image forming apparatus 100, thereby making it possible to avoid increasing the size of the main unit of the image forming apparatus 100. Furthermore, since the air in a room is purified by the ion generating device 71, the space of the room can be used effectively without it being necessary to provide a separate air purifying device, which also enables savings in facilities costs.

Figure 7:
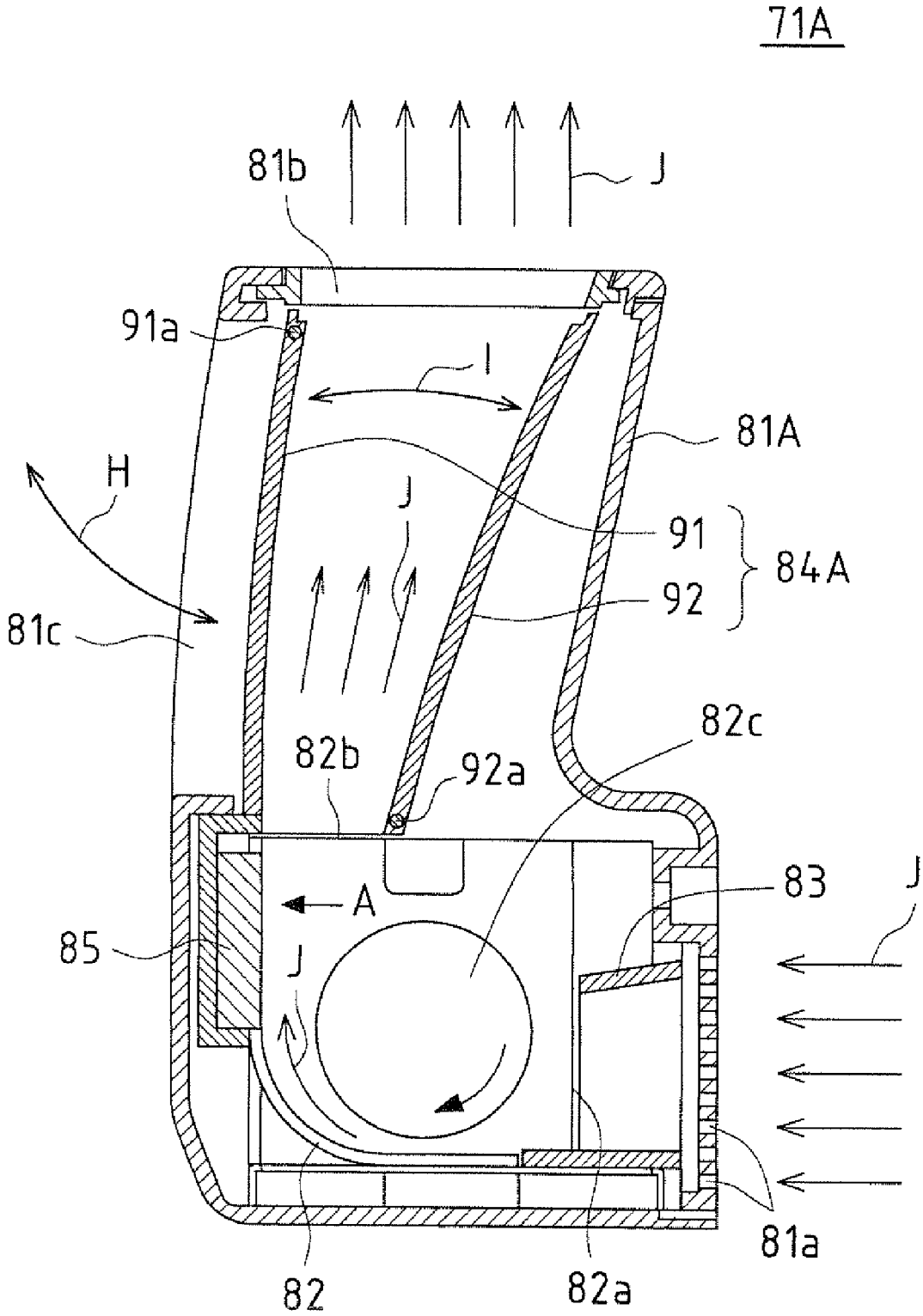
FIG. 7 is a cross-sectional view showing another example of an ion generating device of the image forming apparatus of FIG. 1.

FIG. 7 is a cross-sectional view showing another example of an ion generating device. It should be noted that in FIG. 7, identical symbols are assigned to portions that provide an identical effect as in FIG. 3 and description thereof is simplified.

In an ion generating device 71A shown in FIG. 7, a main casing 81A and an emission duct 84A are provided instead of the main casing 81 and the emission duct 84 of FIG. 3.

The main casing 81A is provided not only with the plurality of intake holes 81*a* and the upper portion blow aperture 81*b* in a same manner as the main casing 81 of FIG. 3, but also with a lateral portion blow aperture 81*c*.

The emission duct 84A is provided with first and second movable duct walls 91 and 92 in opposition to each other. The first movable duct wall 91 is pivotably supported on a shaft 91*a* of its upper end and can rotate in a reciprocating manner in a direction shown by the arrow H around the shaft 91*a*. Furthermore, the second movable duct wall 92 is pivotably supported on a shaft 92*a* of its lower end and can rotate in a reciprocating manner in a direction shown by the arrow I around the shaft 92*a*.

The shafts 91*a* and 92*a* of the first and second movable duct walls 91 and 92 are simultaneously rotationally driven by a duct motor drive unit (not shown in drawings) and simultaneously rotate in a reciprocating manner.

The control portion 74 of the image forming apparatus 100 drives and controls the duct motor drive unit in response to the standby state and operating state of the image forming apparatus 100 to cause the shafts 91*a* and 92*a* of the first and second movable duct walls 91 and 92 to simultaneously move in a reciprocating manner. In this way, the first and second movable duct walls 91 and 92 are selectively positioned as shown in FIG. 7 and FIG. 8.

When the first and second movable duct walls 91 and 92 are positioned as shown in FIG. 7, the first movable duct wall 91 closes the lateral portion blow aperture 81*c*, and therefore the airflow in the ion generating device 71A is generated as shown by the arrows J such that air flows and is emitted upward via a route of the intake holes 81*a*, the intake duct 83, near the ion generating elements 85 in the fan unit 82, the blow aperture 82*b*, the emission duct 84A, and the upper portion blow aperture 81*b*.

Figure 8:
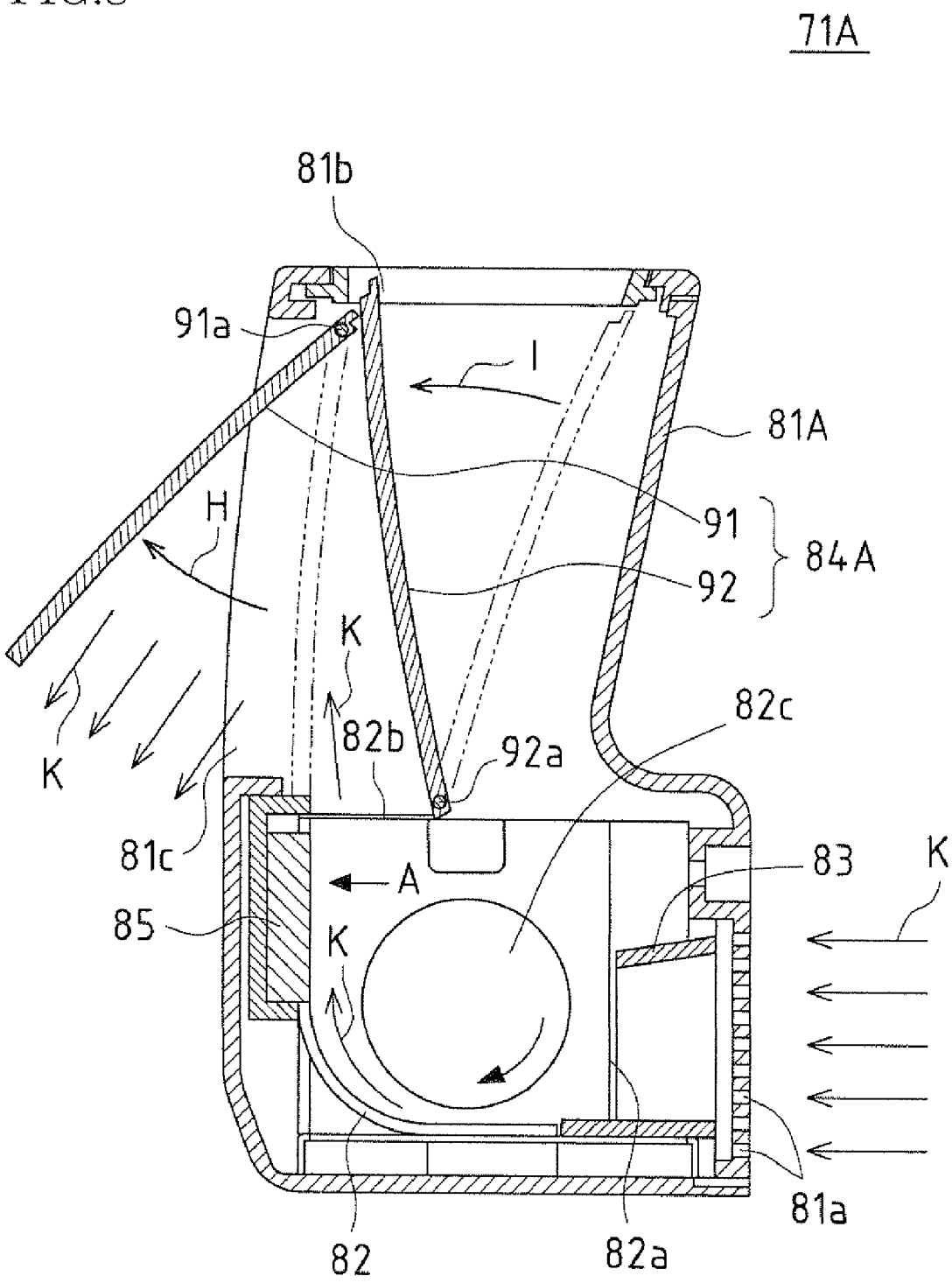
FIG. 8 is a lateral view showing a state in which the emission direction of ions from the ion generating device of FIG. 7 is set diagonally downward.

Furthermore, when the first and second movable duct walls 91 and 92 are positioned as shown in FIG. 8, the first movable duct wall 91 opens the lateral portion blow aperture 81*c* and the second movable duct wall 92 closes the upper portion blow aperture 81*b*, and therefore the airflow in the ion generating device 71A is generated as shown by the arrows K such that air flows and is emitted diagonally downward via a route of the intake holes 81*a*, the intake duct 83, near the ion generating elements 85 in the fan unit 82, the blow aperture 82*b*, and the lateral portion blow aperture 81*c*.

Figure 9:
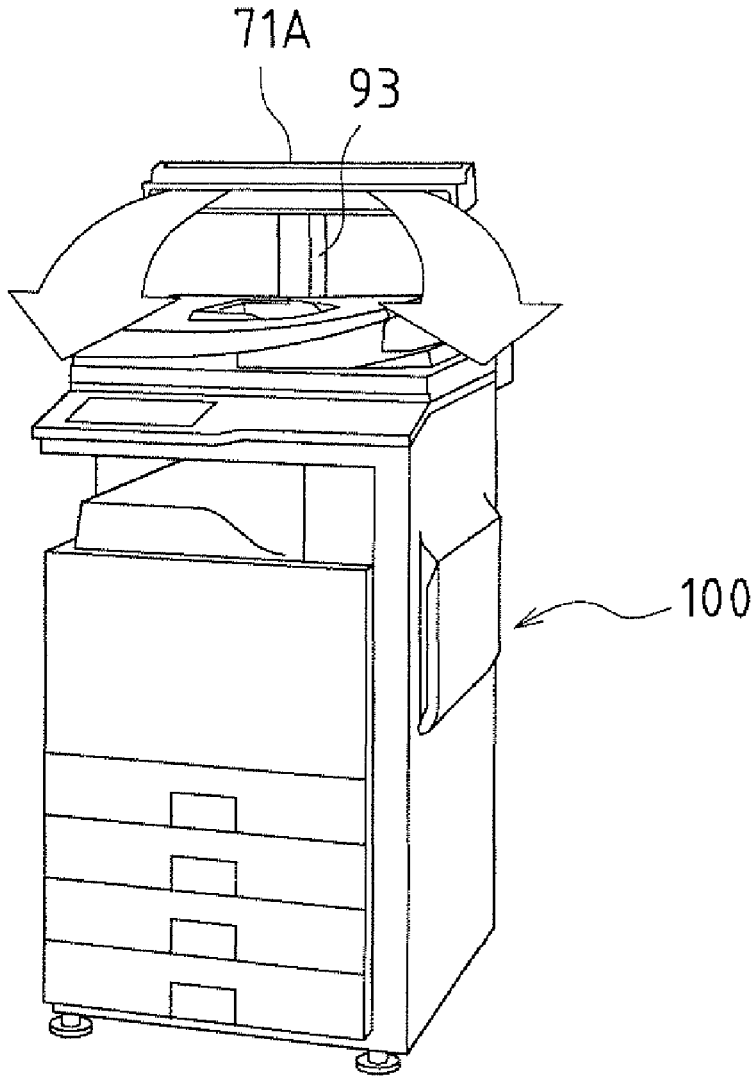
FIG. 9 is a perspective view showing a support structure of the ion generating device of FIG. 7 with the image forming apparatus of FIG. 1.

FIG. 9 shows a state in which the ion generating device 71A is attached to the image forming apparatus 100. A support prop 93 is provided protruding at a rear surface center of the image forming apparatus 100 main unit, and a center of the ion generating device 71A is stably supported at an upper end of the support shaft 93.

Figure 10:
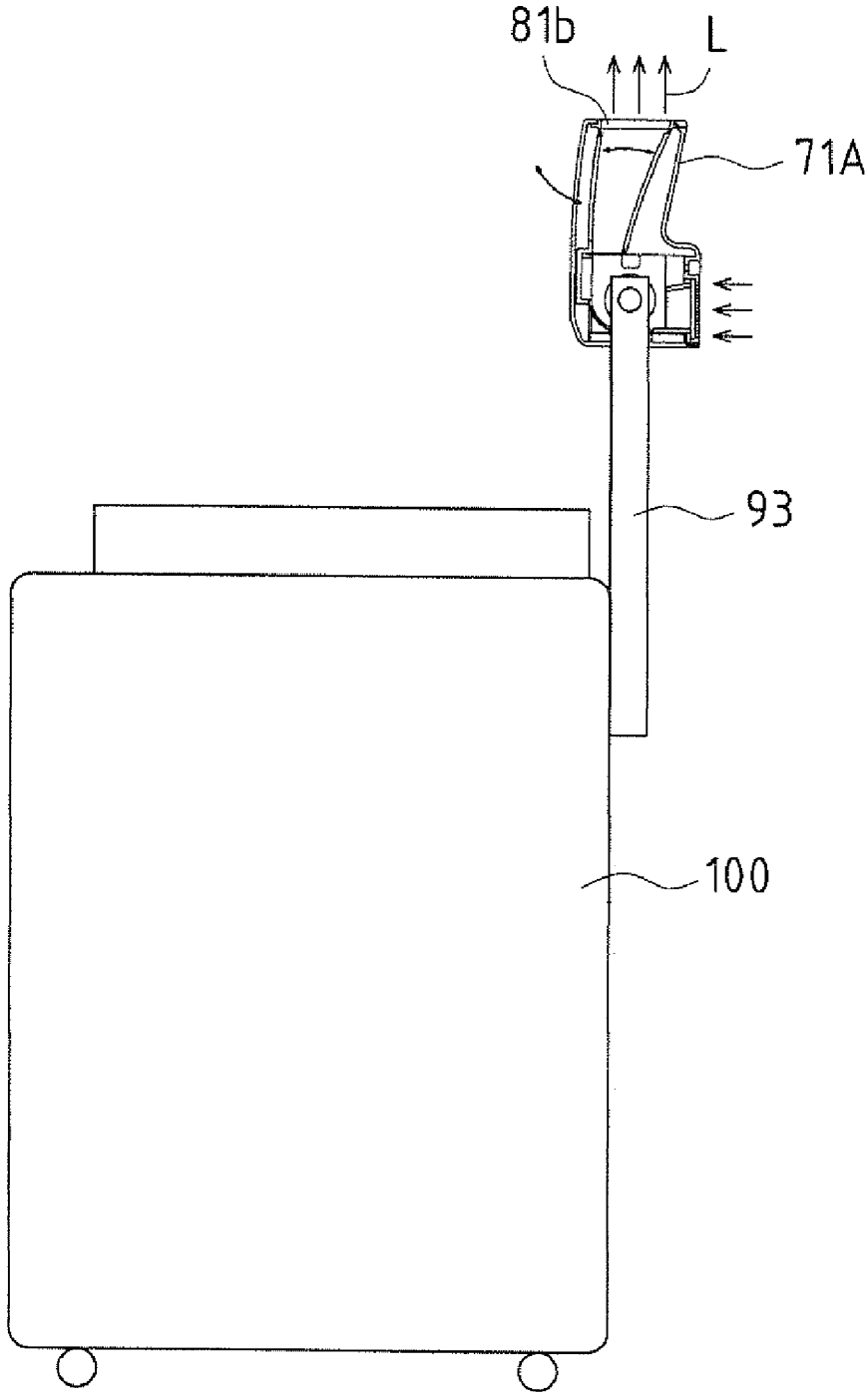
FIG. 10 is a lateral view showing a state in which the emission direction of ions from the ion generating device of FIG. 7 in the image forming apparatus of FIG. 1 is set upward.

Here, when the image forming apparatus 100 is set to a standby state, the control portion 74 drives and controls the duct motor drive unit to cause the shafts 91*a* and 92*a* of the first and second movable duct walls 91 and 92 to simultaneously rotate, and the first and second movable duct walls 91 and 92 become positioned as shown in FIG. 7. For this reason, air from the upper portion blow aperture 81*b* of the ion generating device 71A is emitted in an upward direction (toward opposite side or towards an upper side from the image forming apparatus 100) shown by the arrows L along with positive ions and negative ions as shown in FIG. 10. In this way, positive ions and negative ions are dispersed among the entire room and air purification is performed effectively.

At this time, the emission speed and emission quantity of air from the ion generating device 71A is increased by increasing the rotational speed of the fan 82*c* using drive control of the motor of the fan 82*c* such that the emission range of positive ions and negative ions may be further widened.

Figure 11:
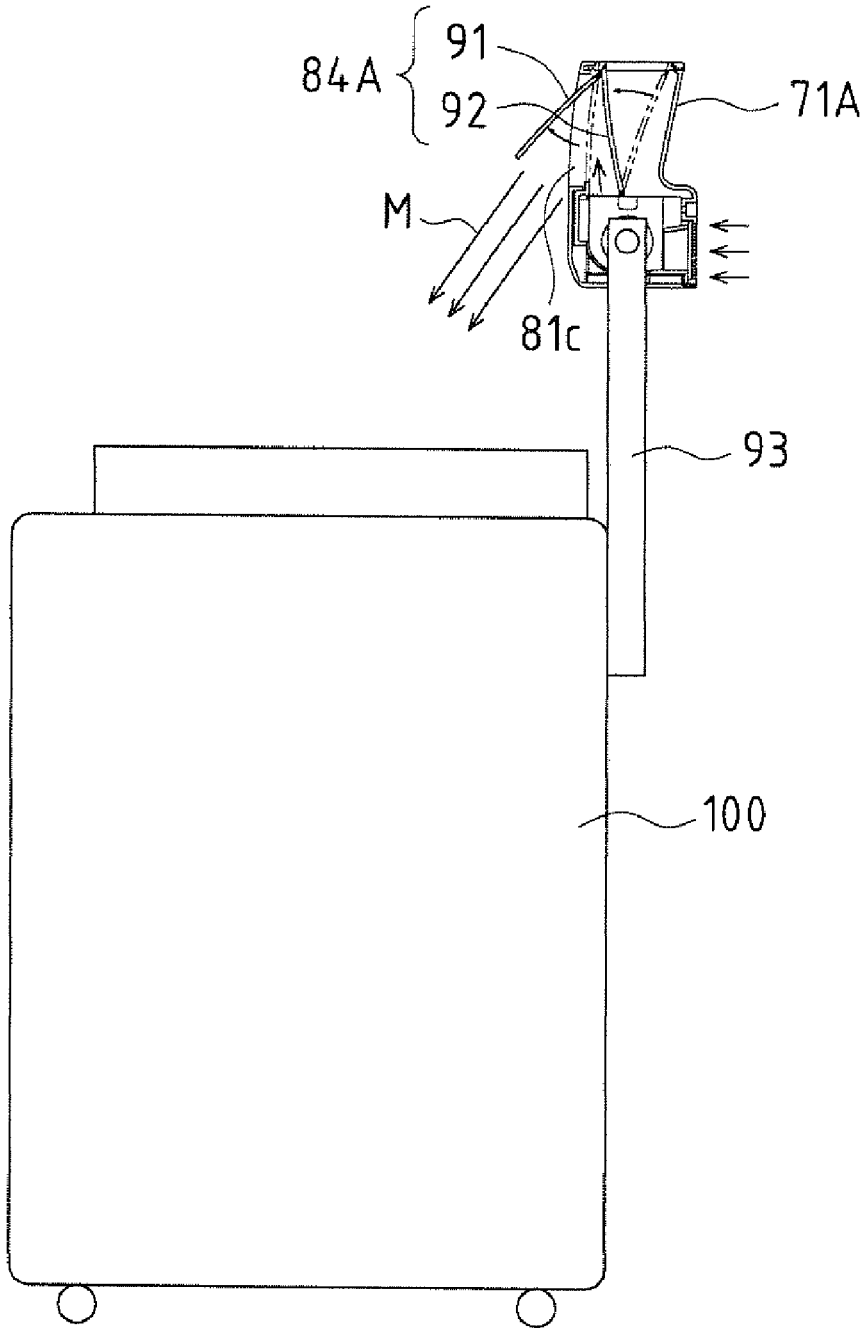
FIG. 11 is a lateral view showing a state in which the emission direction of ions from the ion generating device of FIG. 8 in the image forming apparatus of FIG. 1 is set diagonally downward.

Furthermore, when the image forming apparatus 100 is set to an operating state, the control portion 74 drives and controls the duct motor drive unit to cause the shafts 91*a* and 92*a* of the first and second movable duct walls 91 and 92 to simultaneously rotate, and the first and second movable duct walls 91 and 92 become positioned as shown in FIG. 8. For this reason, air from the lateral portion blow aperture 81*c* of the ion generating device 71A is emitted in a diagonally downward direction (toward the image forming apparatus 100 side) shown by the arrows M along with positive ions and negative ions as shown in FIG. 11. The front side of the main unit of the image forming apparatus 100 is mainly covered by positive ions and negative ions, thereby effectively eliminating the odor of exhaust gases near the user.

At this time, the rotational speed of the fan 82*c* may be decreased using drive control of the motor of the fan 82*c* such that positive ions and negative ions are dispersed moderately and the front side of the main unit of the image forming apparatus 100 may be reliably covered by positive ions and negative ions.

Accordingly, by using the ion generating device 71A in this manner, the emission direction of positive ions and negative ions is varied in response to the standby state and operating state of the image forming apparatus 100, and air purification can be carried out during the standby state and the odors of exhaust gases can be eliminated during the operating state.

The foregoing described preferable embodiments of the present invention with reference to the accompanying drawings, but the present invention is not limited to these examples. It is evident that a person skilled in the art would be capable of conceiving various modifications and alterations within the scope described by the claims, and naturally all of these are to be interpreted as belonging to the technical scope of the present invention.

For example, the foregoing embodiments indicated an operating state and a standby state of the image forming apparatus, but when an image forming apparatus has a continuously long non-operating state, power-conserving control is sometimes carried out in which a transition is made from the standby state to a power-saving state in which the consumption of power is low, then a further transition is made from the power-saving state to a sleeping state in which even less power is consumed, after which a return is made to the operating state when there is a print instruction. As in the standby state, exhaust gases are not produced during the power-saving state and the sleeping state, and therefore the emission direction of ions from the ion generating device may be directed upward such that ions continue to be emitted upward. In particular, the sleeping state is set during night time or the like, and therefore if ions are continuously emitted upward from the ion generating device, the air in a room can be sufficiently purified while people are not present there.

Furthermore, the ion generating device 71 and the motor drive unit 73 may be installed later as options. In this case, a control portion is provided for driving and controlling the motor drive unit 73 or the like on the ion generating device 71 side, and this control portion and the control portion 74 of the image forming apparatus 100 are connected via a serial communications cable and a power point such that instructions are exchanged from the control portion 74 of the image forming apparatus 100 to the control portion of the ion generating device 71 using data communications between the two control portions, thereby performing control of the motor drive unit 73 or the like by the control unit of the ion generating device 71 side.

Further still, the installation position of the ion generating device 71 may be varied in response to factors such as the structure and usage conditions of the image forming apparatus. In the foregoing embodiments, it was assumed that the rear surface side of the image forming apparatus was arranged facing a wall or the like, and the support prop was provided protruding from the rear surface side of the image forming apparatus with the ion generating device 71 being supported horizontally on an upper end of the support prop, but depending on the structure and usage conditions of the image forming apparatus, a lateral surface of the image forming apparatus may be arranged facing a wall or the like. In this case, when the support prop is provided protruding from a lateral surface of the image forming apparatus and the ion generating device 71 is supported on an upper end of the support shaft, the ion generating device 71 is arranged near the wall such that the ion generating device 71 does not become a hindrance. Alternatively, the ion generating device 71 may be attached vertically without using a support prop or may be attached directly to an outer side of the image forming apparatus. Further still, a plurality of ion generating devices 71 may be attached in a dispersed manner.

What is claimed is:

1. An image forming apparatus that prints an image on a recording paper, comprising:

an ion generating means that is attached at an outer side of the image forming apparatus main unit, and generates and emits ions, and an emission direction varying means that varies an emission direction of ions from the ion generating means in response to whether the image forming apparatus is operating or in standby, wherein the emission direction varying means sets an emission direction of ions from the ion generating means in a direction toward the image forming apparatus during operation of the image forming apparatus and sets an emission direction of ions from the ion generating means in a direction away from the image forming apparatus during standby of the image forming apparatus.

2. The image forming apparatus according to claim 1, wherein the ion generating means simultaneously generates and emits positive ions and negative ions.

3. The image forming apparatus according to claim 2, wherein the ion generating means is arranged above the image forming apparatus, and the emission direction varying means sets an emission direction of ions from the ion generating means in a direction above the image forming apparatus during standby of the image forming apparatus.

4. The image forming apparatus according to claim 2, wherein the emission direction varying means varies an emission direction of ions from the ion generating means by varying an orientation of the ion generating means.

5. The image forming apparatus according to claim 1, wherein the ion generating means is arranged above the image forming apparatus, and the emission direction varying means sets an emission direction of ions from the ion generating means in a direction above the image forming apparatus during standby of the image forming apparatus.

6. The image forming apparatus according to claim 5, wherein the emission direction varying means varies an emission direction of ions from the ion generating means by varying an orientation of the ion generating means.

7. The image forming apparatus according to claim 1, wherein the emission direction varying means varies an emission direction of ions from the ion generating means by varying an orientation of the ion generating means.

8. The image forming apparatus according to claim 1, wherein the ion generating means is provided with an ion emission duct surrounded by a duct wall, and the duct wall is movable, and the emission direction varying means varies an emission direction of ions by causing the duct wall of the emission duct to move.

9. The image forming apparatus according to claim 1, wherein the emission direction varying means carries out a swinging operation of repetitively causing the emission direction of ions from the ion generating means to move in a reciprocating manner.

10. The image forming apparatus according to claim 1, wherein the emission direction varying means varies an emission direction of ions from the ion generating means in response to a signal indicating commencement of operation of the image forming apparatus during standby of the image forming apparatus.

11. The image forming apparatus according to claim 10, wherein the image forming apparatus comprises an operation means and an interface connected to an external terminal device, and the signal that indicates commencement of operation of the image forming apparatus is any of a print instruction signal generated in response to an input operation of the operation means and a print instruction signal received and inputted from the external terminal device to the interface.

12. The image forming apparatus according to claim 1, wherein the ion generating means is supported by a support member that is provided protruding upward from the image forming apparatus.

13. The image forming apparatus according to claim 12, wherein the support member is provided protruding upward from a corner of a rear surface side of the image forming apparatus, and supports an end portion of the ion generating means.

14. The image forming apparatus according to claim 12, wherein the support member is provided protruding upward from a center of a rear surface side of the image forming apparatus, and supports a center of the ion generating means.

15. The image forming apparatus according to claim 1, wherein the ion generating means comprises an ion generating element that generates ions, and a ventilation fan that generates a flow of air passing near the ion generating element so as to emit the ions along with the air.

16. An image forming apparatus that prints an image on a recording paper, comprising:

an ion generating means that is attached at an outer side of the image forming apparatus main unit, and generates and emits ions, and an emission direction varying means that varies an emission direction of ions from the ion generating means in response to whether the image forming apparatus is operating or in standby, wherein the emission direction varying means carries out a swinging operation of repetitively causing the emission direction of ions from the ion generating means to move in a reciprocating manner.

17. The image forming apparatus according to claim 16, wherein the emission direction varying means sets an emission direction of ions from the ion generating means in a direction toward the image forming apparatus during operation of the image forming apparatus and sets an emission direction of ions from the ion generating means in a direction away from the image forming apparatus during standby of the image forming apparatus.

18. The image forming apparatus according to claim 16, wherein the ion generating means is arranged above the image forming apparatus, and the emission direction varying means sets an emission direction of ions from the ion generating means in a direction toward the image forming apparatus during operation of the image forming apparatus and sets an emission direction of ions from the ion generating means in a direction above the image forming apparatus during standby of the image forming apparatus.

* * * * *